United States Patent [19]

Sherwood

[11] 4,378,903

[45] Apr. 5, 1983

[54] HANGING TAB WITH SINGLE LINE OF ADHESIVE AND HANGING HOLE CLEAR OF ADHESIVE

[75] Inventor: Irvin W. Sherwood, Downers Grove, Ill.

[73] Assignee: Champion International Corporation, Stamford, Conn.

[21] Appl. No.: 305,493

[22] Filed: Sep. 25, 1981

[51] Int. Cl.[3] ..... B65D 5/46

[52] U.S. Cl. ..... 229/6 R; 229/52 B; 206/806

[58] Field of Search ..... 229/6 R, 8, 38, 43, 229/52 B; 206/806; 248/318, 322, 339; 211/71

[56] References Cited

U.S. PATENT DOCUMENTS

| | | | |
|---|---|---|---|
| 2,979,192 | 4/1961 | Blandu | 206/806 |
| 3,946,936 | 3/1976 | Brown | 206/806 |
| 4,266,671 | 5/1981 | Roccafurte | 206/806 |
| 4,279,376 | 7/1981 | Roccafurte | 206/806 |
| 4,291,807 | 9/1981 | Giordano | 206/806 |
| 4,315,569 | 2/1982 | Jaeschke | 206/806 |

*Primary Examiner*—Herbert F. Ross
*Attorney, Agent, or Firm*—Evelyn M. Sommer

[57] ABSTRACT

A carton for encasing and displaying merchandise, said carton utilizing a hanging tab at the upper end of the carton extending from the rear wall of the carton. The hanging tab comprises a pair of panels extending in series from the rear wall of the carton and said pair of panels being folded back into surface-to-surface engagement with each other, and then folded back as a composite panel against the rear wall. One of the panels is provided with an opening hanging hole, and the other is provided with a closed hanging hole having a plug bounded by rupturable score lines. The rear wall is embossed at an area which registers with that portion of the hanging tab which is to have a through hanging opening. The panel having the plug is provided with a strip of adhesive traversing the plug and extending beyond the score lines onto the remainder of the panel. The adhesive secures the pair of panels together when folded in surface-to-surface engagement with each other, and, the adhesive on the plug contacts the embossed area, through the open hanging hole, to secure the folded tab to the rear panel of the carton. When the hanging tab is pulled to its extended operative position, the score lines rupture and the plug is left secured to the rear panel of the carton by passing through the open hanging hole. A compound hanging hole is thus formed in the extended tab. The hanging tab then extends vertically from the vertical rear wall and has the clean compound mounting hole for mounting on a rack or other display device.

4 Claims, 10 Drawing Figures

FIG. 5.
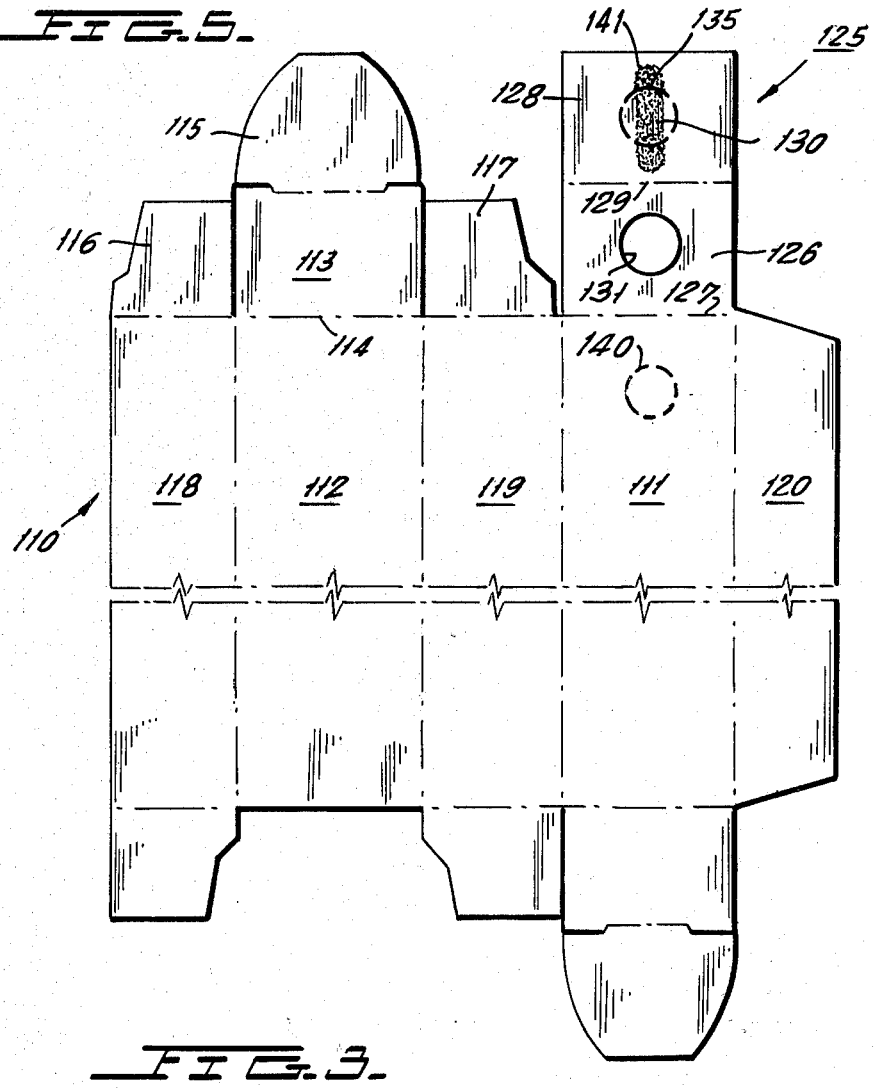
FIG. 3.
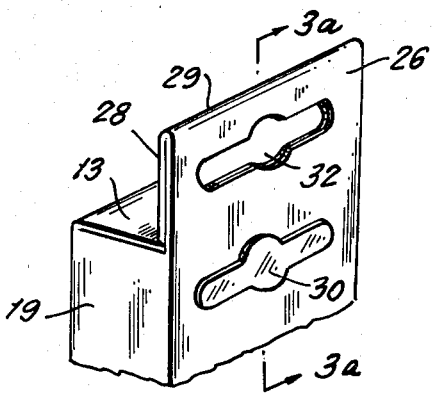
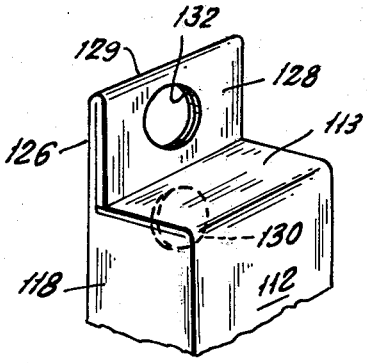
FIG. 4.

HANGING TAB WITH SINGLE LINE OF ADHESIVE AND HANGING HOLE CLEAR OF ADHESIVE

The present invention relates to display containers for articles of merchandise and particularly to the method of forming the container and a hanging tab therefor so that the container may be placed on a rack, pegboard, or other device for display and be removed by the consumer and taken to a checkout counter.

In the construction of cartons utilizing such a hanging tab it has been customary to provide a hanging tab extension extending from a vertical rear wall of the carton opposite the edge from which the panel which forms the cover for the carton extends. The hanging tab is most frequently a doubled panel so that it may be folded back on itself and adhesively secured together with a hole passing through the two panels to provide the means for hanging the carton.

In addition, to avoid accidental damage or removal of the hanging tab during shipment, the hanging tab has frequently been bent back against the exterior of the rear wall of the carton and lightly adhesively secured thereto. This permits appropriate packing of the individual merchandise carrying cartons in multiple in a larger carton so that they may be shipped without danger of damaging the hanging tab and without increasing the volume of the shipping carton. Thereafter, at the point of display, the hanging tab is unfolded from the rear wall of the carton to the erect position and placed on a pin, peg, or other display device from which it may readily be removed. For this purpose the hanging tab must necessarily as above pointed out be lightly secured to the back wall of the carton so that it will remain in position during the shipment but may readily be rotated to its hanging position. Heretofore in the utilization and operation of cartons having such hanging tabs, the adhesive securement of the hanging tab to the rear wall of the carton before the hanging tab is unfolded and arranged for display, at times interfered with the opening or hole in the hanging tab. Thus when the hanging tab had been unfolded, part of the adhesive which held the hanging tab in place against the rear wall of the carton during shipment, extended as a partial film into or across the hole. This did not necessarily interfere with the hanging operation but tended to present an unfinished appearance just at the point of display which was most visible to the customer. In addition, the extension of part of the film of adhesive or even a part of a very thin layer of the carton rear wall which might have been torn loose during the unfolding operation into the hole, interfered with the presentation of a sightly and clean structure. Also, this might result, after successive cartons were placed on and removed from the display device, in forming a deposit of adhesive on the pins, fingers, rods or pegs of the display device which interfered with the effectiveness of the display device itself.

Since the hanging tab extends upwardly from the carton, it provides a surface for further display and pictorial material. But this surface happens to be just at the area where the hanging hole is located and any possibly unsightly film or deposit at or adjacent the hole of the hanging tab will detract from the effectiveness of the display.

The present invention is directed to the formation of the hanging tab and the adhesive securement of the tab to the back wall of the carton from which it extends in such manner that when the hanging tab is peeled loose from the back wall of the carton and rotated to the erect position as a vertical extension of the back wall of the carton, there will be no possibility of any adhesive material, which was originally used to secure the hanging tab temporarily in place, appearing at the hole and no possibility of any thin peel-off layer of paper or other material extending across the hole.

As primary object of the present invention the foregoing problem is solved in accordance with the present invention by embossing the rear wall of the carton at the area which will register with the hole in the hanging tab when the hanging tab is folded back and adhesively secured to the rear wall of the carton. Adhesive is placed on a plug which fills one of the holes through one of the two panels which form the hanging tab, the other panel being provided with an open hole which is aligned with the plug. The adhesive coated plug contacts the embossed area which projects into the open hole on the other panel, and the embossed area provides a surface on the rear wall whereby temporary securement of the hanging tab to the rear wall is obtained. Thereafter when the hanging tab is peeled off the back of the carton, folded up along the hinged connection or fold line of the rear wall to the vertical position where it constitutes an extension of the rear wall, the plug remains adhered to the embossed area and the through hole is formed on the hanging tab.

Essentially the present invention contemplates that the material which will form the plug for the hole of the hanging tab can be adhesively secured to the embossed portion of the rear wall of the carton. Appropriate cuts are made in the hanging tab to define the portion which will form the plug for the hole. When the hanging tab is pulled up and away from the rear wall of the carton, the weakened portion of the area of the hanging tab surrounding the hole will permit the adhesive to retain the material of the hanging tab which occupied the hole, i.e. the plug, when the hanging tab is folded up. This plug, which is thereby removed to provide the completed through hole, will stay secured to the embossed area at the rear wall of the carton while the hanging tab is folded upwardly to the erect display position where the hanging tab is a vertical extension of the vertical wall of the carton.

It has been found that by this means, a plurality of steps are avoided. The manufacture of the carton is simplified, the hanging tab may be made on the automatic machinery which forms the carton, and folded back and adhesively secured to the outer surface of the rear wall of the carton in the original collapsed form in which it is made, the carton may then be erected and filled and the material to be contained therein inserted, the lid closed, and the carton shipped. At the point of sale, the hanging tab may then be unfolded as above described with the material which originally extended across the area which was to be the hole in the hanging tab now staying secured to the embossed portion of the rear wall and a clean hanging hole is provided.

The hanging tab must have sufficient strength to support the carton and any object placed therein. By way of example, the carton may contain a pair of windshield wipers, or a tool such as a screwdriver, a pair of pliers, or other relatively heavy device. The hanging tab must, of course, have sufficient strength to support an article of that type and the hole and structure must be sufficiently strong so that it will not be torn by the weight of such an article or by possible successive removals and replacements of the carton on the rack by different customers.

The foregoing and many other objects of the present invention will become apparent from the following description and drawings in which:

FIG. 1 is a view in perspective of one form which a novel carton of the present invention may take, looking at the rear wall of the carton with the hanging tab held in place against the rear wall of the carton and not yet unfolded.

FIG. 1*a* is a cross-sectional view taken on line 1*a*—1*a* of FIG. 1 looking in the direction of the arrows showing the hanging tab glued to the rear wall of the carton.

Figure 3A:
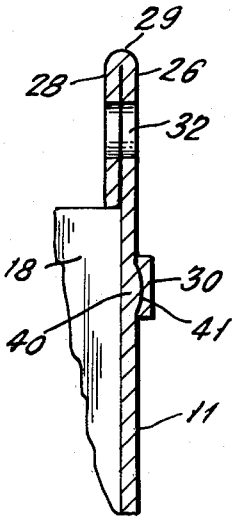
FIG. 3 is a partial view in perspective of the upper half of the carton of FIG. 1 showing the hanging tab peeled from the rear wall of the carton and the lid of the carton closed with the hanging tab extending as a vertical extension of the vertical rear wall.

FIG. 3*a* is a cross sectional view taken on line 3*a*—3*a* of FIG. 3 looking in the direction of the arrows.

Figure 2:
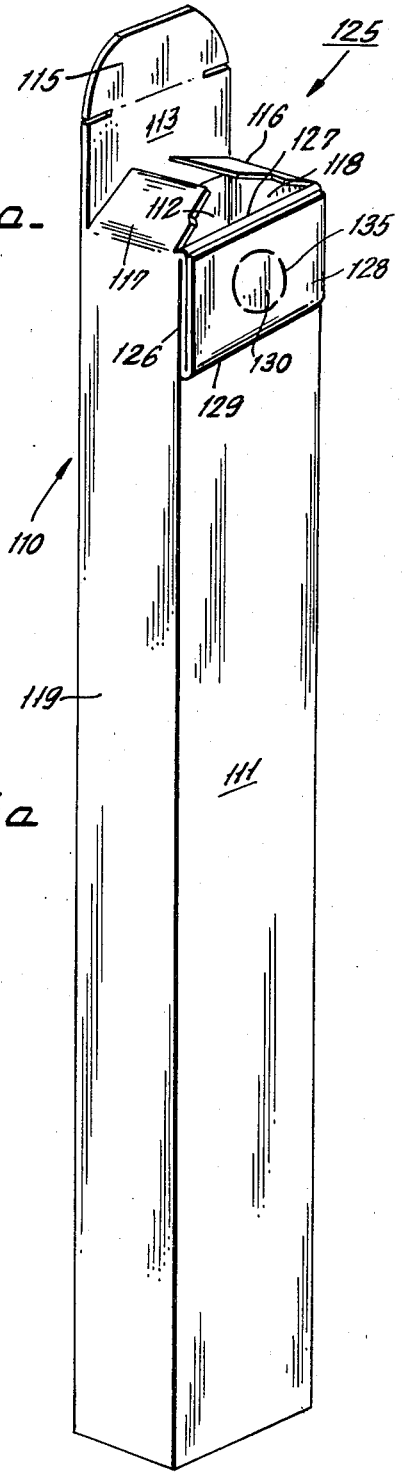
FIG. 2 is a view in perspective of a second form which the present invention may take where, again, the hanging tab is shown folded back and temporarily adhesively secured to the rear vertical wall of the carton.

FIG. 4 is a view in perspective of the upper section of the carton of FIG. 2 showing the hanging tab peeled from the rear wall and folded up to extend as a vertical extension of the rear wall and the top of the carton closed.

FIG. 5 is a partial plan view showing the inside surface of a blank for forming the carton of FIG. 2.

Figure 6:
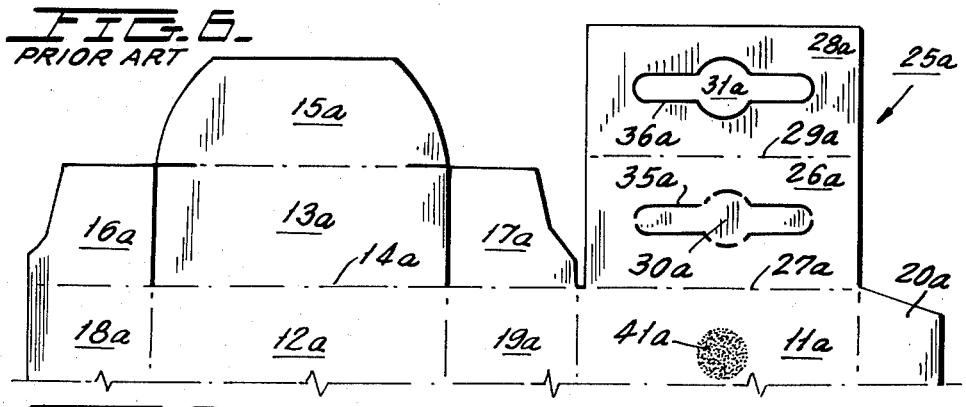
FIG. 6 PRIOR ART

FIG. 6 is a partial plan view of the outside surface of a blank for forming a carton of the prior art.

Figure 1:
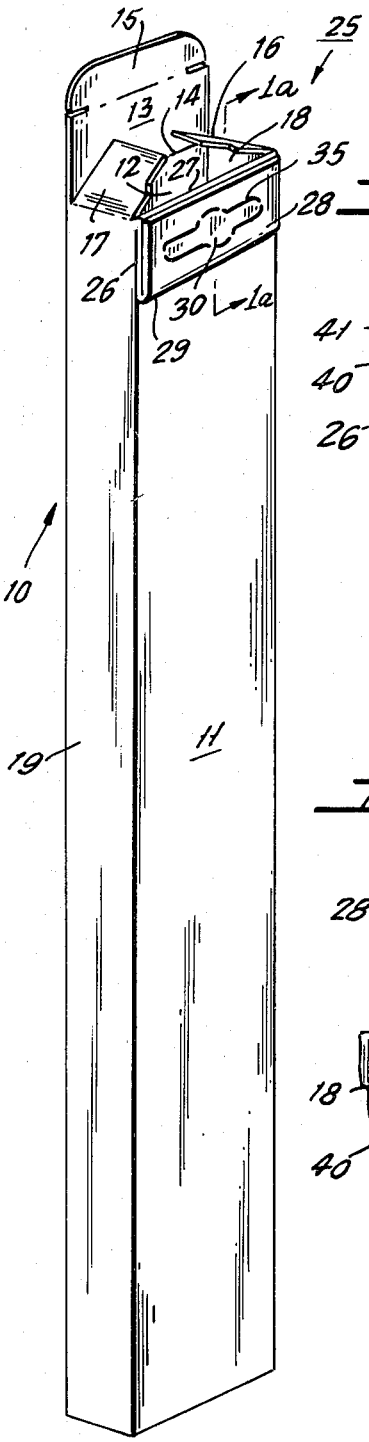
Figure 1A:
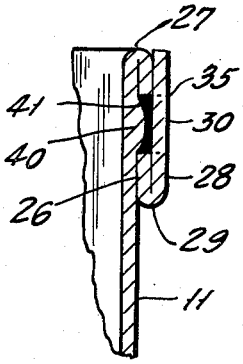
Figure 7:
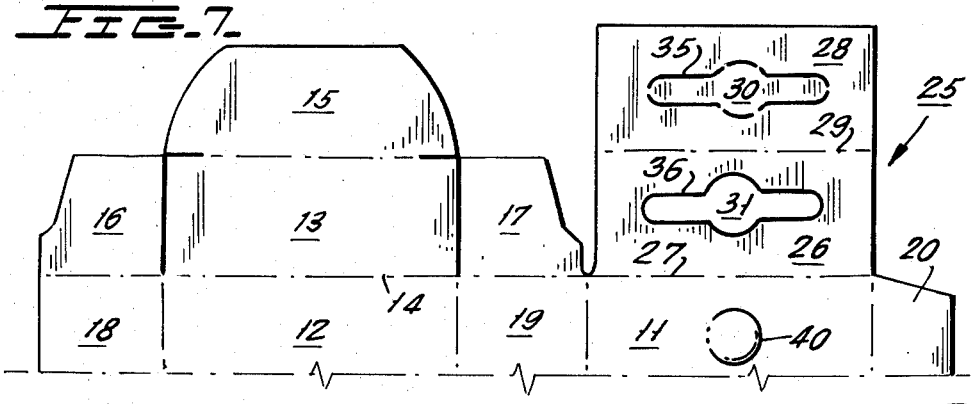

FIG. 7 is a partial plan view of the outside surface of a blank showing the location of the embossed area of the structure of FIGS. 1, 1*a* and 3*a*.

Figure 8:
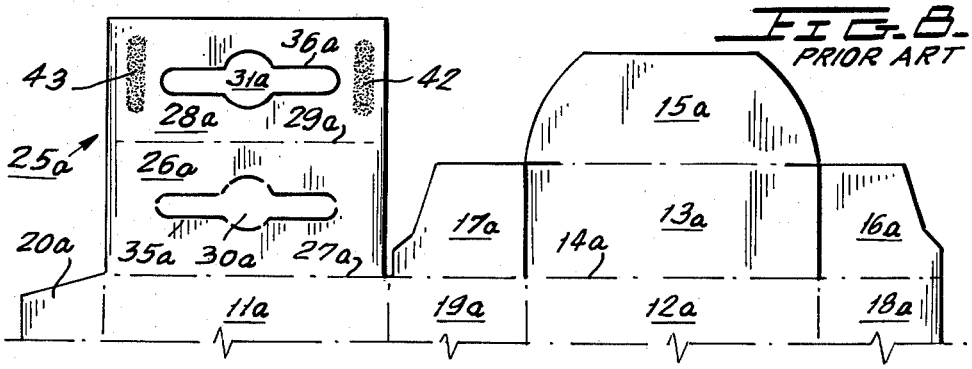
FIG. 8 PRIOR ART

FIG. 8 is a partial plan view of the inside surface of the prior art blank shown in FIG. 6.

Figure 9:
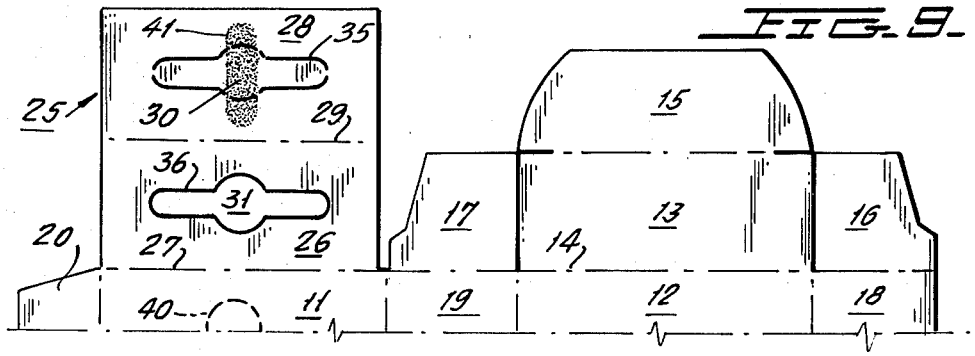

FIG. 9 is a partial plan view of the inside surface of the blank of FIG. 7 showing the manner of application of the adhesive thereto.

As previously pointed out, the function of the present invention is to cause a hanging tab of double thickness to be folded over so that the double thickness is adhesively secured to form a heavier hanging tab and at the same time to temporarily secure the hanging tab which is hingedly extended from the rear wall of the carton back against the rear wall or panel of the carton in order to protect the hanging tab during shipment and to make it possible to ship a large number of the cartons in a single package.

The double thickness of the hanging tab is needed not only to provide space for indicia and graphic display but also to strengthen the upper segment of the hanging hole to support the heavy product which will be enclosed in the carton. Previous structures required two adhesive operations, (1) the application of one or two spots of adhesive on the inside of the board, (2) the application of a spot of adhesive inside the hanging hole on the printed side of the board or in an area of the back panel or wall of the carton corresponding to the hanging hole, or (3) the application of adhesive elsewhere on the hanging panel than at the hanging hole and stripping the hanging panel.

The present invention eliminates the need to provide two separate gluing operations, and requires the performance of only a single gluing operation. The hanging tab is formed in two similar panels separated from each other by a transverse medial fold line. A first one of the panels is provided with an open hanging hole, and a second one of the panels is provided with a scored area defining a plugged hanging hole. To erect the hanging tab, a single glue spot is disposed on the inner surface of the second hanging panel so as to traverse the plug and extend beyond the scored area. The two panels are then brought into face-to-face relationship by folding along the transverse medial fold line so that the plug is brought into registry with the open hanging hole. The glue extending beyond the scored area will bond the two panels together. The glue traversing the plug will be operable, through the open hanging hole, to adhere the plug, and thus the folded hanging tab, to the rear panel of the carton when the hanging tab is folded about a base fold line against the rear panel. To ensure a secure bond between the plug and the rear panel, the latter is embossed in the area contiguous with the open hanging hole so that the embossed part will project into the open hanging hole to contact the glue disposed on the plug. The open hanging hole is preferably made somewhat larger than the plug, so that, when the hanging tab is pulled away from the rear panel of the carton to its operable position, the plug will easily remain adhered to the rear panel and will pass through the open hanging hole. Once the plug is detached from the scored panel, the compound hanging hole is completely opened and ready for use.

Referring first to FIGS. 1, 1*a*, 3, 3*a* and 7, the carton 10 comprises a rear wall or panel 11, a front panel 12, a cover panel 13 hingedly connected at the fold line 14 to the top of the front panel 12, and an extension 15 of the lid which may be inserted around the dust excluding panels 16 and 17 to lie in surface-to-surface relation with the interior of the rear panel 11 in order to close the carton. The rear panel 11 is connected to the front panel 12 by a pair of side panels 18 and 19 from which the dust excluding panels 16 and 17 extend. An appropriate glue flap 20 is provided extending from the side edge of rear panel 11 which may be adhesively secured in any suitable manner to the side panel 18 in order to complete the carton in collapsed tubular form. The bottom of the carton may have the general construction shown in FIG. 5 but essentially constitutes a structure wherein the bottom of the tubular container formed by the blank of FIG. 1 may be closed and sealed prior to the insertion of an article of merchandise at the top.

The rear wall or panel 11 has extending therefrom the hanging panel 25 which comprises panel 26 hingedly connected by the fold line 27 to the upper edge of rear wall 11 and panel 28 hingedly connected by the fold line 29 to the upper edge of panel 26. As seen in FIGS. 1, 1*a*, 3 and 3*a*, the panels 28 and 26 are folded into engagement with each other around the fold line 29 and adhesively secured together.

It will be noted that the panel 26 is formed with an open hanging hole 31 bounded by edge 36, and the panel 28 is formed with a hanging hole which is filled with a plug 30 and bounded by a score line 35 which allows removal of the plug 30 from the panel 28, as will be described in further detail hereinafter.

The rear panel 11 of the carton is provided with an embossed area 40 which is contiguous with the open hole 31 when the hanging tab 25 is folded along fold line 27 to lie against the rear panel 11, as shown in FIG. 1*a*. The adhesive 41 is applied to the panel 28, as shown in FIG. 9, in a strip extending across the plug 30 and onto the adjoining surface of the panel 28 outside of the score line 35. The panel 28 is then folded about fold line 29 into juxtaposition with the panel 26. The ends of the adhesive strip 41 bond the panels 26 and 28 together in face-to-face relationship, and the adhesive which is disposed on the plug 30 is exposed to the embossement 40 through the open hanging hole 31 when the hanging tab 25 is folded about fold line 27 into juxtaposition with the outside surface of the rear panel 11. After the latter folding step is performed, the hanging tab 25 will be adhered to the rear panel 11 as shown in FIG. 1*a*. When the hanging tab 25 is pivoted about the fold line 27 to its operative position, as shown in FIG. 3*a*, the plug 30 will remain adhered to rear panel 11. In effect, the adhesive 41 causes the plug 31 to be pulled through the open hanging hole 31 rupturing the score line 35 and leaving the compound hanging hole 32 ready for use on the compound hanging tab 25.

This is in contrast with the prior art where, as shown in FIGS. 6 and 8, a similar structure is used with the corresponding parts being given the same reference numbers plus the letter "a". Instead, however, of the embossed area 40, a glue spot 41*a* is used to hold the folded hanging tab 25*a* against the rear panel 11*a* of the carton by adhering to the plug 30*a*. To glue the panels 26*b* and 28*b* together, additional glue spots 42 and 43 are used.

It will be noted in all of the foregoing operations, the present invention requires only a single glue operation in order to create the double panel tab 25 and to cause it to be adhered to the rear wall or panel of the carton.

In FIGS. 2, 4 and 5 there is shown a modified form of the structure utilizing the embossed element 140. All of the elements of the carton except for those which differ from that of FIGS. 1 and 7 have been given the same reference number plus "100" and require no further specific description here. It will be noted in the blank of FIG. 5, which is shown with its inside surface toward the viewer, that glue may be applied in a single elongated area, as shown at 141, in order to provide not only the adhesive which secures the two panels 126 and 128 of the hanging tab 125 together but also temporarily secures the hanging tab 125, via the plug 130 to the embossed section 140 of the carton. The panel 128 is provided with weakening lines or nicks 135 defining the plug 130 which is to be removed to form part of the hanging hole. The other panel 126 is provided with an open hanging hole 131. The glue may thus be applied from the inside of the carton onto a portion of the panel and extending across the plug 130, which is later removed to complete formation of the hole. Thereafter, the panel 128 is folded, in the case of the showing of FIG. 5, around the hinge line 129 into surface-to-surface relation with the panel 126 and then the composite panel tab is folded once more around the hinged line 127 so that the adhesive coated surface of the plug 130 will be in adhesive contact with the embossed section 140.

Thereafter when the composite hanging tab 125 is peeled off the embossed section, the plug 130, of the panel 128 will be left on the embossed section 140 and the compound hole 132 will be formed in the hanging tab.

Thus it will be clear that the use of the embossed section on the rear wall of the carton provides a simplified method for ensuring that the hole of the hanging tab will be clear and will present a neat and professional appearance so that the carton may readily be placed on the display rack for removal and use by the customer.

In the foregoing, the present invention has been described in connection with the illustrative embodiments thereof. Since many variations and modifications of the present invention will now be obvious to those skilled in the art, it is preferred that the scope of the present invention be determined not by the disclosure alone but by the appended claims.

What is claimed is:

1. A hanging assembly connected to an end of a paperboard container wall, said hanging assembly comprising:

(a) a first panel foldably connected to said end of said container wall, said first panel being provided with a through hole, and said first panel being folded about a first fold line into face-to-face contact with a surface of said container wall;

(b) a second panel foldably connected to said first panel, said second panel being provided with a cut score line defining a plug conforming to the shape of said through hole, and said second panel being folded about a second fold line into face-to-face contact with said first panel with said plug being contiguous to said through hole;

(c) adhesive means disposed between said first and second panels to adhesively secure said panels together to form a compound hanging tab, said adhesive means extending across said plug and being operative, via said through opening, to adhesively secure said plug and said hanging tab to said container wall;

(d) said score line being operable to rupture when said hanging tab is pivoted to an operative position away from said container wall about said first fold line thereby leaving said plug adhered to said container wall and, forming a compound opening through said hanging tab; and (e) said container wall includes an embossed portion projecting into said through opening to provide a limited area for securement of said plug to said container wall.

2. The hanging assembly of claim 1, wherein said plug is sufficiently smaller in size than said through opening to facilitate passage of said plug through said through opening when said hanging tab is pivoted to said operative position.

3. A carton having a hanging assembly, said carton comprising a front wall, a rear wall, and a pair of side walls connecting said front and rear walls, bottom and top closures for closing opposite ends of said carton, said hanging assembly comprising:

(a) a hanging tab adapted to extend vertically from an end of said rear wall, said hanging tab comprising a first extension foldably connected to said end of said rear wall, said first extension being formed with a first hole therethrough, and a second extension foldably connected to said first extension, said second extension being formed with a cut score line bounding a plug operative, when removed from said second extension, to form a second hole through said second extension;

(b) said extensions being secured together in face-to-face relationship by adhesive means extending across said plug and sandwiched between said extensions, said plug and said first hole being in registry with each other; and (c) said hanging tab being folded against said rear wall of said carton with said first extension being in face-to-face contact with said rear wall of said carton, said adhesive means on said plug being operable to adhere said plug, and thereby said hanging tab, to said rear wall of said carton through said hole in said first extension, and said plug being operable to be torn from said second extension to remain adhered to said rear wall of said carton when said hanging tab is pivoted away from said rear wall of said carton to an operable vertically extended position, whereby the removal of said plug from said second extension completes formation of a through hanging hole in said hanging tab, said rear wall of said carton has an embossed area projecting into said first hole in said first extension when said hanging tab is folded against said rear wall, said embossed area being adhered to said plug.

4. The carton of claim 3, wherein said plug is smaller in size than said first hole.

* * * * *